US006940432B1

(12) United States Patent
Hall

(10) Patent No.: US 6,940,432 B1
(45) Date of Patent: Sep. 6, 2005

(54) SUBLIMINAL RECORDING DEVICE

(76) Inventor: Vern Hall, 4516 Auhay Dr., Santa Barbara, CA (US) 93110

( * ) Notice: Subject to any disclaimer, the term of this patent is extended or adjusted under 35 U.S.C. 154(b) by 0 days.

(21) Appl. No.: 10/743,477

(22) Filed: Dec. 22, 2003

(51) Int. Cl.[7] ..... H03M 1/00
(52) U.S. Cl. ..... 341/110; 704/275; 446/142
(58) Field of Search ..... 341/110; 704/272; 446/142

(56) References Cited

U.S. PATENT DOCUMENTS 4,772,873 A * 9/1988 Duncan ..... 341/110
5,738,526 A * 4/1998 Cerda et al. ..... 434/304
6,290,566 B1 * 9/2001 Gabai et al. ..... 446/175
6,585,556 B2 * 7/2003 Smirnov ..... 446/175
2001/0041496 A1 * 11/2001 Smirnov ..... 446/297
2003/0235808 A1 * 12/2003 Hardison ..... 434/236
2004/0049393 A1 * 3/2004 Duran et al. ..... 704/275

* cited by examiner

*Primary Examiner*—Howard L. Williams
(74) *Attorney, Agent, or Firm*—Michael I. Kroll

(57) ABSTRACT

An apparatus for recording and replaying a message comprising a plurality of control buttons for controlling the apparatus; a processor connected to the record control button for communicating instructions to a memory; a memory connected to the processor for storing audio data; a microphone connected to the memory for providing audio data to the memory; and a speaker connected to the memory for producing audio output. Upon activation of a first of said plurality of control buttons a microphone is controlled to receive audio data. The microphone provides the received audio data to a memory for storing the audio data. Upon activation of a second of said plurality of control buttons the processor controls the memory to provide the stored audio data to the speaker for audiblizing at predetermined intervals.

7 Claims, 8 Drawing Sheets

SUBLIMINAL RECORDING DEVICE

BACKGROUND OF THE INVENTION

1. Field of the Invention

The present invention relates to recording devices and, more specifically, to a recording device designed for subliminal suggestions, including a combined LCD alarm clock and recording device. The recording device digitally records a user's message and repeats the message in delayed increments of time. The recording device is able to record a message and replay the message at predetermined intervals until the cycle terminates or until activation of a stop button. Preferably, the recorded message is an affirmation or subliminal message in the user's voice which is continually listened to while the user sleeps. Additionally, the apparatus may include a teddy bear or other stuffed animal encasing, which is conducive to use of the invention by a child.

2. Description of the Prior Art

Numerous other types of recording devices exist in the prior art, including tape recorders, MP3 devices, digital voice recorders, and cell phone recorders, none of which, however, can record messages and repeatedly play them back at predetermined intervals. While these devices may be suitable for the purposes for which they were designed, they would not be as suitable for the purposes of the present invention, as hereinafter described.

SUMMARY OF THE PRESENT INVENTION

The present invention relates to recording devices and, more specifically, to a recording device designed for subliminal suggestions, including a combined LCD alarm clock and recording device. The recording device digitally records a user's message and repeats the message in delayed increments of time. The recording device is able to record a message and replay the message at predetermined intervals until the cycle terminates or until activation of a stop button. Preferably, the recorded message is an affirmation or subliminal message in the user's voice which is continually listened to while the user sleeps. Additionally, the apparatus may include a teddy bear or other stuffed animal encasing, which is conducive to use of the invention by a child.

A primary object of the present invention is to provide a recording device that overcomes the shortcomings of the prior art.

A secondary object of the present invention is to provide a recording device that includes an LCD alarm clock.

Another object of the present invention is to provide a recording device including a processor, memory, microphone, speaker, adjustable volume, audio output jack, and a plurality of control buttons.

Yet another object of the present invention is to provide a recording device wherein a plurality of control buttons activates at least one of a RECORD function, a PLAY function, a START function, a MODE function, and a SET function.

A further object of the present invention is to provide a recording device that is encased in a teddy bear.

Another object of the present invention is to provide a recording device encased in a teddy bear wherein the control buttons are positioned on the external surface of the teddy bear.

Yet a further object of the present invention is to provide a recording device that plays back a recorded message at predetermined intervals.

Still another object of the present invention is to provide a recording device wherein playback of the recorded message may be delayed for a predetermined period to allow the user to fall asleep prior to playback.

An even further object of the present invention is to provide a recording device for replaying the recorded messages at predetermined intervals after the delay period.

Another object of the present invention is to provide a recording device wherein the replay of the message provides subliminal instructions to the user.

Yet another object of the present invention is to provide a recording device wherein the replay of the message provides affirmations to the user.

A further object of the present invention is to provide a recording device wherein the replay of the message provides subliminal suggestions to the user.

Still another object of the present invention is to provide a recording device simple and easy to use.

Still yet another object of the present invention is to provide a recording device that is inexpensive to manufacture and use.

Additional objects of the present invention will appear as the description proceeds.

The present invention overcomes the shortcomings of the prior art by providing a recording device that plays a recorded message in the user's voice in delayed intervals in order to allow a user to listen to the messages while sleeping. The recording device is combined with an LCD alarm clock and is selectively positioned adjacent or atop a bed in which the user sleeps. The recording device may also be encased in a teddy bear or other stuffed animal so as to be positioned unobjectionably adjacent or atop a child's bed. The recording device includes a plurality of control buttons, which control the functions of the device. Using these control buttons, the user can record affirmations or subliminal messages for improving the self-confidence, self-image, and way the user lives his or her life.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
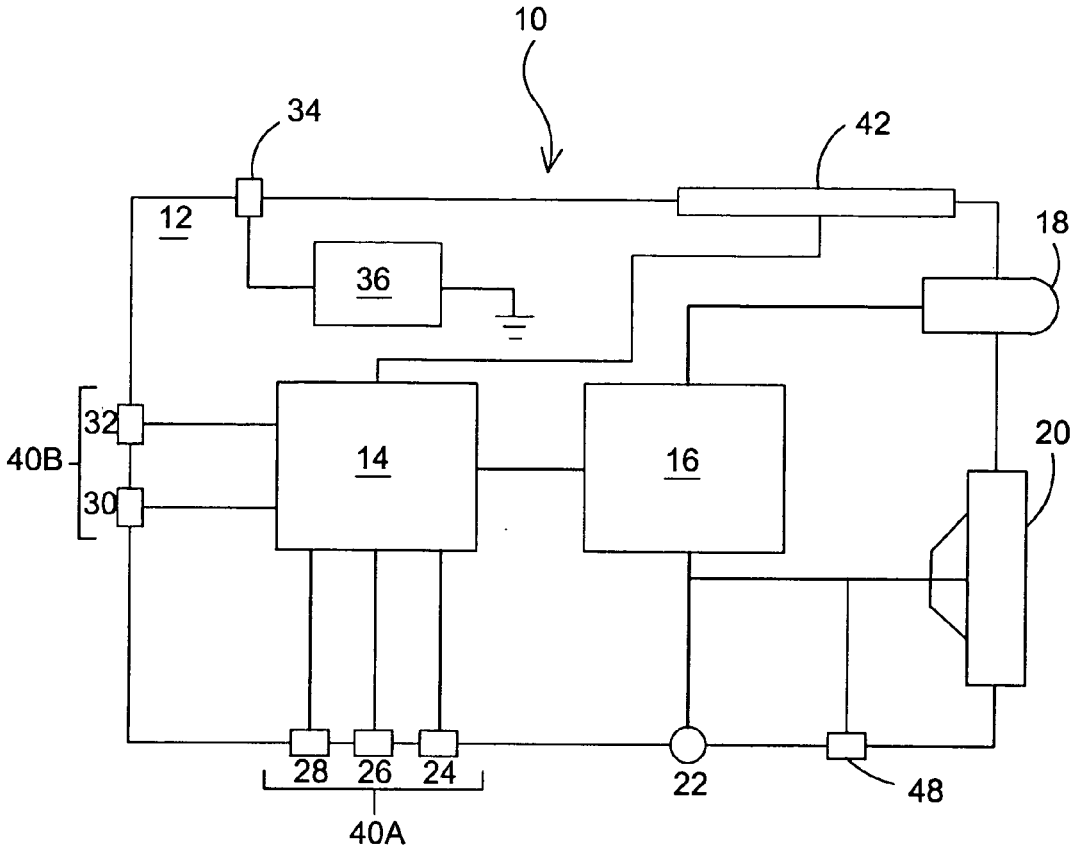
FIG. 1 is a block diagram of the recording device of the present invention.

Turning now descriptively to the drawings, in which similar reference characters denote similar elements throughout the several views, the Figures illustrate the recording device of the present invention. With regard to the reference numerals used, the following numbering is used throughout the various drawing Figures.

10 recording device of the present invention
12 main body
14 processor
16 memory
18 microphone
20 speaker
22 volume control
24 START control button
26 MODE control button
28 SET control button
30 PLAY control button
32 RECORD control button
34 AC/DC power socket
36 power source
40 control buttons set 1
41 control buttons set 2
42 liquid crystal character display (LCD) screen
46 battery cover
48 audio output jack
50 teddy bear encasing
52 control button extensions

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views. FIGS. 1 through 9 illustrate the recording device of the present invention indicated generally by the numeral 10.

FIG. 1 is a block diagram of the recording device 10 of the present invention. The recording device 10 includes a main body 12, a processor 14, and a memory 16, connected to the processor 14 and positioned within the main body 12. The internal parts include the processor 14 and the memory 16, which communicate with each other and other parts through a set of connections. The main body 12 also includes a power source 36 connected to the processor 14 for providing power to the recording device 10. The power source 36 is preferably at least one of a battery, power acquired from external sources via AC/DC power socket 34, or any other means for powering the components of the recording device 10. Positioned on the main body 12 is a microphone 18, speaker 20, volume control 22, AC/DC power socket 34, first set of control buttons 40, second set of control buttons 41, LCD screen 42, and an audio output jack 48. The first set of control buttons 40 includes a START control button 24, MODE control button 26, and SET control button 28. The second set of control buttons 41 includes a PLAY control button 30 and RECORD control button 32. The control buttons 24, 26, 28, 30, and 32 are connected to the processor 14. The microphone 18 and speaker 20 are connected to the memory 16. The volume control 22 is connected to the processor for controlling the volume of speaker 20.

Upon pressing the RECORD control button 32, processor 14 signals the memory 16 to store data received from the microphone 18. Additionally, the processor 14 signals the LCD display to display "REC" thereon indicating the device is in the record mode. Preferably, the microphone 18 captures analog audio data representing the user's voice. The audio data is then converted into digital data and stored in the memory 16. If data was previously stored in memory 16, the previously stored data will be automatically deleted and replaced by the new message.

Upon pressing the PLAY control button 30, processor 14 signals the memory 16 to convert the digital data into analog data for output by the speaker 20. Hereinafter, the above described process will be known as "Replay." Simultaneously, the processor 14 signals the LCD display 42 to display "PLAY" thereon indicating the device is in the play mode. The Replay can be terminated at any time by pressing either the PLAY control button 30 or RECORD control button 32. If the user wishes to listen to the Replay through earphones, the earphones can be inserted into audio output jack 48, which causes the Replay to be output through the audio output jack 48. The user can also adjust the volume of the Replay by selectively moving the volume control 22 for increasing and decreasing the level at which Replay is output through the speaker 20 or audio output jack 48.

If the user presses the START control button 24, the processor 14 signals the memory 16 to perform a Replay in accordance with a timing mechanism configured in processor 14. The timing mechanism predetermines the intervals at which Replays occur. For example, the timing mechanism may include a cycle of twenty Replays simultaneously, followed by a delayed period of an hour, followed by another cycle of twenty Replays, for seven hours. In the above example, the processor 14 signals the memory 16 to perform a Replay 20 consecutive times. The processor 14 includes a timing mechanism for keeping time. When one hour has expired according to the timing mechanism in the processor 14, the processor signals the memory 16 to Replay the stored data twenty consecutive times. The processor 14 would continue this cycle until the timing mechanism determines that a seventh hour has passed. The pattern continues until the cycle of the timing mechanism completes or the user terminates the cycle by pressing the PLAY control button 30. Preferably the default configuration of the timing mechanism is as follows: one Replay and then stop; one hour later Replay twenty times and then stop; two hours later Replay twenty times and then stop; two hours later Replay twenty times and then stop; two hours later Replay twenty times and then stop. However, the above is described for purpose of example only and the cycle of Replays may be performed at any time intervals and for any number of cycles.

If the user presses and holds the SET control button 28 for a predetermined amount of time, the processor 14 causes control buttons 24, 26, 30, and 32 to be locked in an inoperable state. The processor 14 simultaneously signals the LCD display 42 to display "HOLD" thereon. When the user presses and holds the SET control button 28 for a second predetermined amount of time, the processor 14 causes the control buttons 24, 26, 30, and 32 to be unlocked and operable. Preferably, the predetermined amount of time is two seconds. However, the predetermined amount of time may be greater or less than two seconds.

If the user presses and holds the MODE control button 26 for a predetermined amount of time, the processor 14 instructs the recording device to enter into a clock setting mode, while simultaneously causing the LCD display 42 to display the digital clock with the minutes flashing. In the clock setting mode, the user inputs data representing the hour of the day which is simultaneously displayed on the LCD display 42. The user can then press SET control button 28 to adjust the minutes as displayed on the LCD display 42. By pressing the MODE control button 26 again, the user can toggle between hour, year, month, day, and hour display type (12:00 or 24:00) in sequence. By pressing the SET control button 28, the user can adjust the values accordingly. By maintaining the SET control button 28 in a depressed position, the user can speed up the adjustment process. If the user does not press any control buttons for five seconds, the processor terminates the function and ends the clock setting.

If the user presses (without holding) the MODE control button 26, the processor 14 causes the recording device to enter into an alarm setting mode, while simultaneously causing the LCD display 42 to display "ALARM." In the alarm setting mode, the processor 14 collects the information input by the user while simultaneously displaying that information on the LCD display 42. If the user depresses the MODE control button 26 for a predetermined amount of time, while the recording device is in the alarm setting mode, the processor 14 causes the LCD display 42 to display the clock with the minutes field flashing. Thereafter, the user presses the SET control button 28 to adjust the minutes as displayed on the LCD display 42. By pressing the MODE control button a second time, the user can switch to hour, year, month, day, alarm on/off, and alarm type. By pressing the SET control button 28, the user can adjust the values of the above fields accordingly. By holding the SET control button 28, the user can speed up the adjustment process. The alarm types include "0", which is a daily alarm, and "1", which is the special recorder message playing circuit function, as described above. At the time when the alarm activates, the user can deactivate the alarm by pressing any control button.

Figure 2:
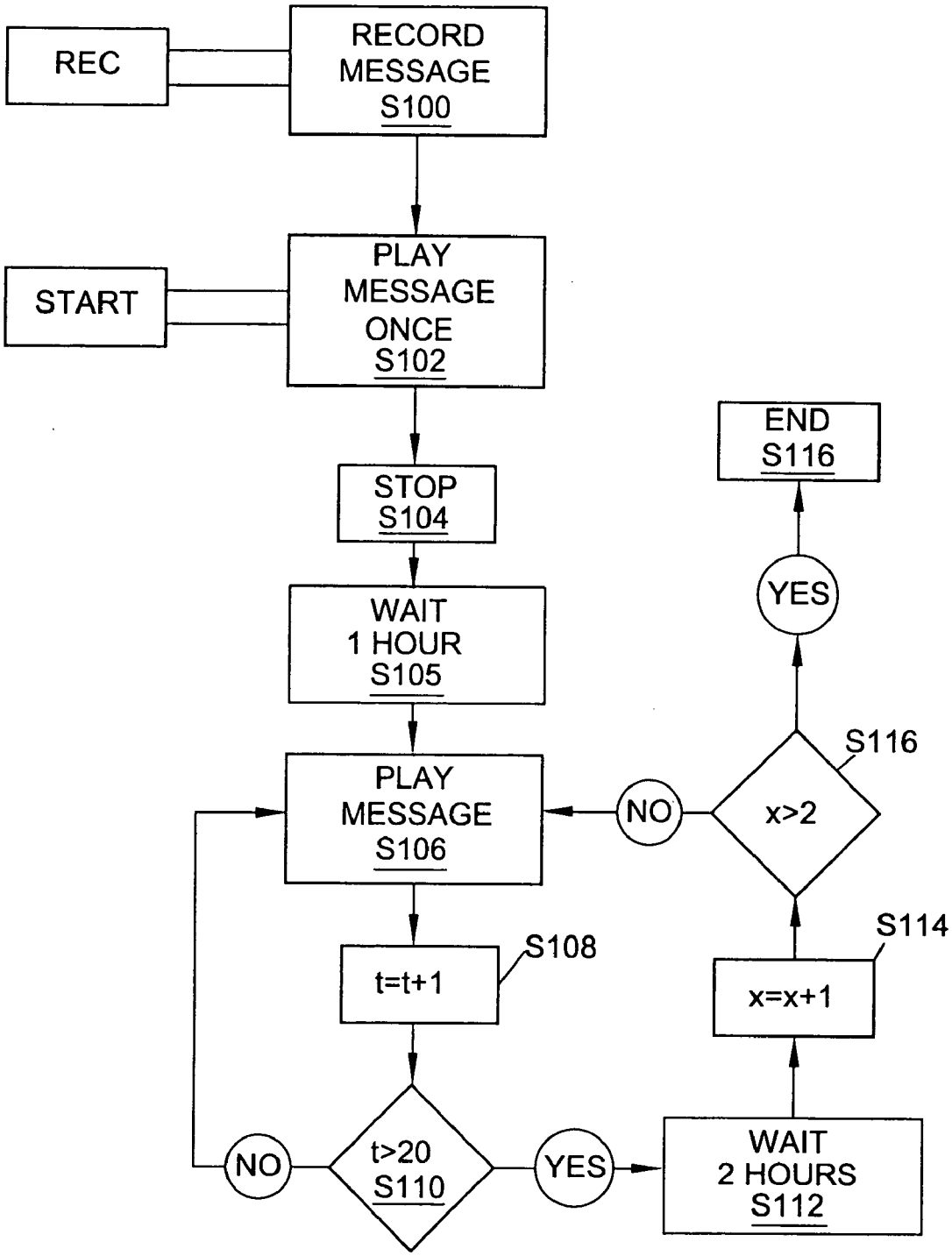
FIG. 2 is a flow diagram illustrating the method of using the recording device of the present invention.

FIG. 2 is a flow diagram that illustrates the steps performed in the main function of the recording device of the present invention. In step S100, the user presses the RECORD control button and records a message. In step S102, the user presses the START control button before he or she goes to sleep. The recording device plays the message back once and then stops, as stated in step S104. In step 105, the timing mechanism in the processor waits for one hour. At the expiration of the hour, the processor instructs the memory to replay the message again, as stated in step S106. The processor then increments a counter in step S108. In step S110, the value of the counter is checked to see if it is greater than twenty. If the value is less than or equal to twenty, the message is repeated. If the value of the counter is greater than twenty, the device delays Replay for two hours. After two hours elapses, a second counter is incremented in step S114. The value of the counter is checked in step S116. If the counter value is less than or equal to two, the process returns to step S106 to replay the message. If the counter value is greater than two, the processed is stopped as in step S118. The user can terminate the cycle at any time by pressing the PLAY control button, also shown in step S118.

Figure 3:
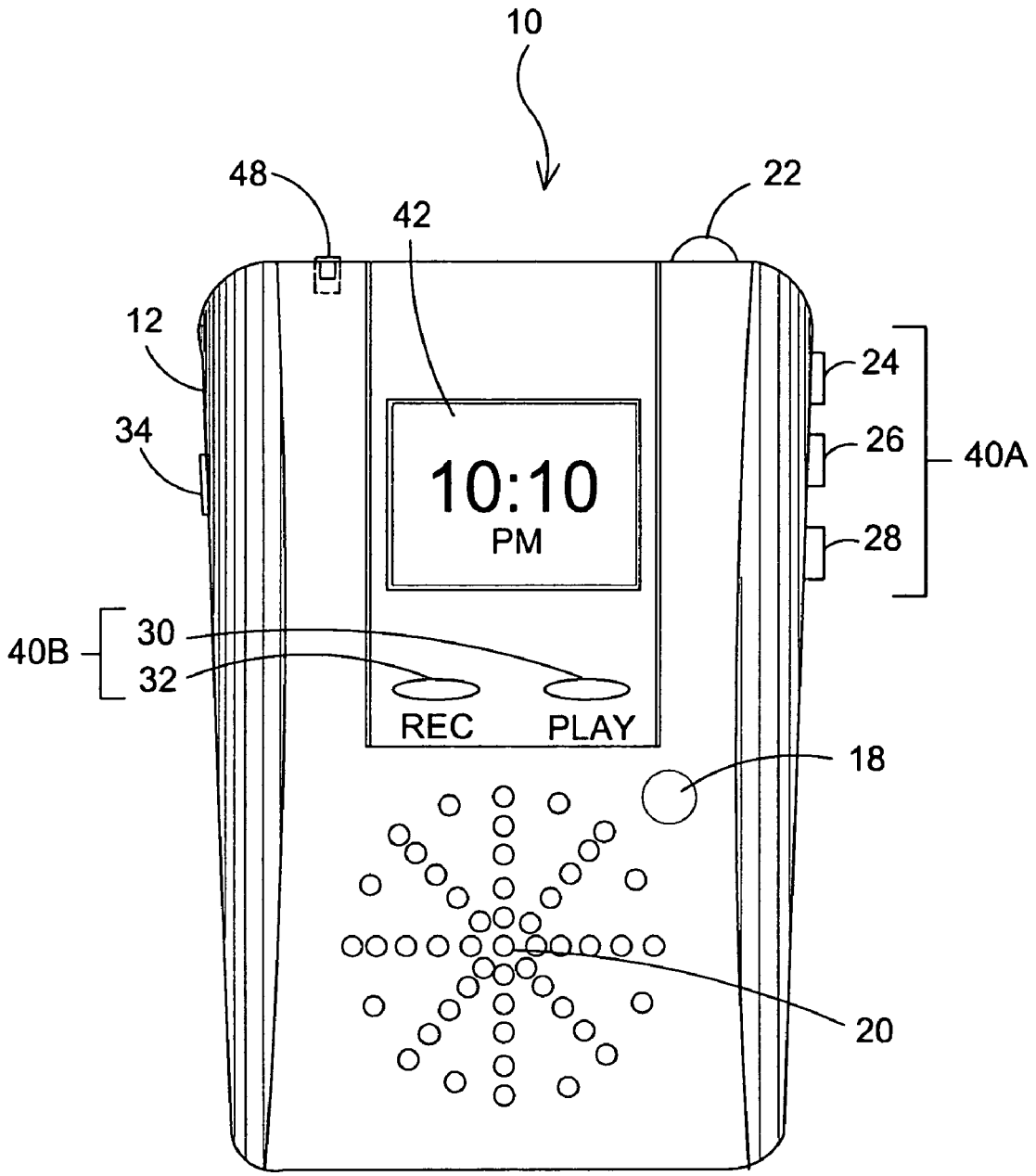
FIG. 3 is a front view of the recording device of the present invention.

FIG. 3 is a front view of the recording device 10 of the present invention. A plurality of pieces fit together as the main body 12. Positioned on the main body of the recording device 10 are the microphone 18, speaker 20, volume control 22, AC/DC power socket 34, first set of control buttons 40, second set of control buttons 41, LCD screen 42, and audio output jack 48. The first set of control buttons 40 includes the START control button 24, MODE control button 26, and SET control button 28. The second set of control buttons 41 includes the PLAY control button 30 and RECORD control button 32.

Upon pressing the RECORD control button 32, processor 14 signals the memory 16 to store data received from the microphone 18. Additionally, the processor 14 signals the LCD display to display "REC" thereon indicating the device is in the record mode. Preferably, the microphone 18 captures analog audio data representing the user's voice. The audio data is then converted into digital data and stored in the memory 16. If data was previously stored in memory 16, the previously stored data will be automatically deleted and replaced by the new message.

If the user presses the START control button 24, the processor 14 signals the memory 16 to perform a Replay in accordance with a timing mechanism configured in processor 14. The timing mechanism predetermines the intervals at which Replays occur. For example, the timing mechanism may include a cycle of twenty Replays simultaneously, followed by a delayed period of an hour, followed by another cycle of twenty Replays, for seven hours. In the above example, the processor 14 signals the memory 16 to perform a Replay 20 consecutive times. The processor 14 includes a timing mechanism for keeping time. When one hour has expired according to the timing mechanism in the processor 14, the processor signals the memory 16 to Replay the stored data twenty consecutive times. The processor 14 would continue this cycle until the timing mechanism determines that a seventh hour has passed. The pattern continues until the cycle of the timing mechanism completes or the user terminates the cycle by pressing the PLAY control button 30. Preferably the default configuration of the timing mechanism is as follows: one Replay and then stop; one hour later Replay twenty times and then stop; two hours later Replay twenty times and then stop; two hours later Replay twenty times and then stop; two hours later Replay twenty times and then stop. However, the above is described for purpose of example only and the cycle of Replays may be performed at any time intervals and for any number of cycles.

If the user presses and holds the SET control button 28 for a predetermined amount of time, the processor 14 causes control buttons 24, 26, 30, and 32 to be locked in an inoperable state. The processor 14 simultaneously signals the LCD display 42 to display "HOLD" thereon. When the user presses and holds the SET control button 28 for a second predetermined amount of time, the processor 14 causes the control buttons 24, 26, 30, and 32 to be unlocked and operable. Preferably, the predetermined amount of time is two seconds. However, the predetermined amount of time may be greater or less than two seconds.

If the user presses and holds the MODE control button 26 for a predetermined amount of time, the processor 14 instructs the recording device to enter into a clock setting mode, while simultaneously causing the LCD display 42 to display the digital clock with the minutes flashing. In the clock setting mode, the user inputs data representing the hour of the day which is simultaneously displayed on the LCD display 42. The user can then press SET control button 28 to adjust the minutes as displayed on the LCD display 42. By pressing the MODE control button 26 again, the user can toggle between hour, year, month, day, and hour display type (12:00 or 24:00) in sequence. By pressing the SET control button 28, the user can adjust the values accordingly. By maintaining the SET control button 28 in a depressed position, the user can speed up the adjustment process. If the user does not press any control buttons for five seconds, the processor terminates the function and ends the clock setting.

If the user presses (without holding) the MODE control button 26, the processor 14 causes the recording device to enter into an alarm setting mode, while simultaneously causing the LCD display 42 to display "ALARM." In the alarm setting mode, the processor 14 collects the information input by the user while simultaneously displaying that information on the LCD display 42. If the user depresses the MODE control button 26 for a predetermined amount of time, while the recording device is in the alarm setting mode, the processor 14 causes the LCD display 42 to display the clock with the minutes field flashing. Thereafter, the user presses the SET control button 28 to adjust the minutes as displayed on the LCD display 42. By pressing the MODE control button a second time, the user can switch to hour, year, month, day, alarm on/off, and alarm type. By pressing the SET control button 28, the user can adjust the values of the above fields accordingly. By holding the SET control button 28, the user can speed up the adjustment process. The alarm types include "0", which is a daily alarm, and "1", which is the special recorder message playing circuit function, as described above. At the time when the alarm activates, the user can deactivate the alarm by pressing any control button.

Figure 4:
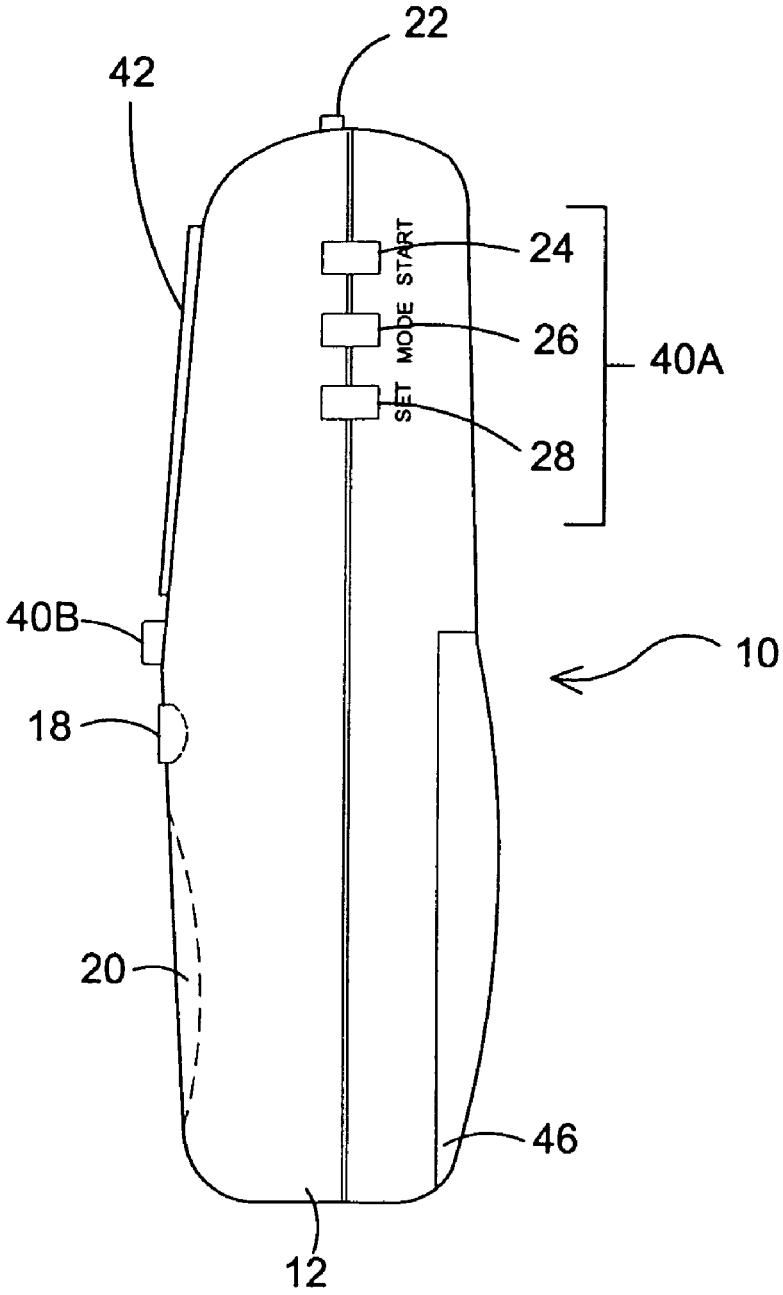
FIG. 4 is a side view of the recording device of the present invention.

FIG. 4 is a side view of the recording device 10 of the present invention. A plurality of pieces fit together as the main body 12. Positioned on the outside of the recording device 10 is the microphone 18, speaker 20, volume control 22, first set of control buttons 40, second set of control buttons 41, LCD screen 42, and battery cover 46. The first set of control buttons 40 includes the START control button 24, MODE control button 26, and SET control button 28. Battery cover 46 connects with the main body 12 to hold the battery (not shown) within the recording device 10. As illustrated in FIG. 4, the recording device 10 is slim, yet balanced to stand upright. The slim structure and the optional battery power source make the recording device easy to transport.

If the user presses the START control button 24, the processor 14 signals the memory 16 to perform a Replay in accordance with a timing mechanism configured in processor 14. The timing mechanism predetermines the intervals at which Replays occur. For example, the timing mechanism may include a cycle of twenty Replays simultaneously, followed by a delayed period of an hour, followed by another cycle of twenty Replays, for seven hours. In the above example, the processor 14 signals the memory 16 to perform a Replay twenty consecutive times. The processor 14 includes a timing mechanism for keeping time. When one hour has expired according to the timing mechanism in the processor 14, the processor signals the memory 16 to Replay the stored data twenty consecutive times. The processor 14 would continue this cycle until the timing mechanism determines that a seventh hour has passed. The pattern continues until the cycle of the timing mechanism completes or the user terminates the cycle by pressing the PLAY control button 30. Preferably the default configuration of the timing mechanism is as follows: one Replay and then stop; one hour later Replay twenty times and then stop; two hours later Replay twenty times and then stop; two hours later Replay twenty times and then stop; two hours later Replay twenty times and then stop. However, the above is described for purpose of example only and the cycle of Replays may be performed at any time intervals and for any number of cycles.

If the user presses and holds the SET control button 28 for a predetermined amount of time, the processor 14 causes control buttons 24, 26, 30, and 32 to be locked in an inoperable state. The processor 14 simultaneously signals the LCD display 42 to display "HOLD" thereon. When the user presses and holds the SET control button 28 for a second predetermined amount of time, the processor 14 causes the control buttons 24, 26, 30, and 32 to be unlocked and operable. Preferably, the predetermined amount of time is two seconds. However, the predetermined amount of time may be greater or less than two seconds.

If the user presses and holds the MODE control button 26 for a predetermined amount of time, the processor 14 instructs the recording device to enter into a clock setting mode, while simultaneously causing the LCD display 42 to display the digital clock with the minutes flashing. In the clock setting mode, the user inputs data representing the hour of the day which is simultaneously displayed on the LCD display 42. The user can then press SET control button 28 to adjust the minutes as displayed on the LCD display 42. By pressing the MODE control button 26 again, the user can toggle between hour, year, month, day, and hour display type (12:00 or 24:00) in sequence. By pressing the SET control button 28, the user can adjust the values accordingly. By maintaining the SET control button 28 in a depressed position, the user can speed up the adjustment process. If the user does not press any control buttons for five seconds, the processor terminates the function and ends the clock setting.

If the user presses (without holding) the MODE control button 26, the processor 14 causes the recording device to enter into an alarm setting mode, while simultaneously causing the LCD display 42 to display "ALARM." In the alarm setting mode, the processor 14 collects the information input by the user while simultaneously displaying that information on the LCD display 42. If the user depresses the MODE control button 26 for a predetermined amount of time, while the recording device is in the alarm setting mode, the processor 14 causes the LCD display 42 to display the clock with the minutes field flashing. Thereafter, the user presses the SET control button 28 to adjust the minutes as displayed on the LCD display 42. By pressing the MODE control button a second time, the user can switch to hour, year, month, day, alarm on/off, and alarm type. By pressing the SET control button 28, the user can adjust the values of the above fields accordingly. By holding the SET control button 28, the user can speed up the adjustment process. The alarm types include "0", which is a daily alarm, and "1", which is the special recorder message playing circuit function, as described above. At the time when the alarm activates, the user can deactivate the alarm by pressing any control button.

Figure 5:
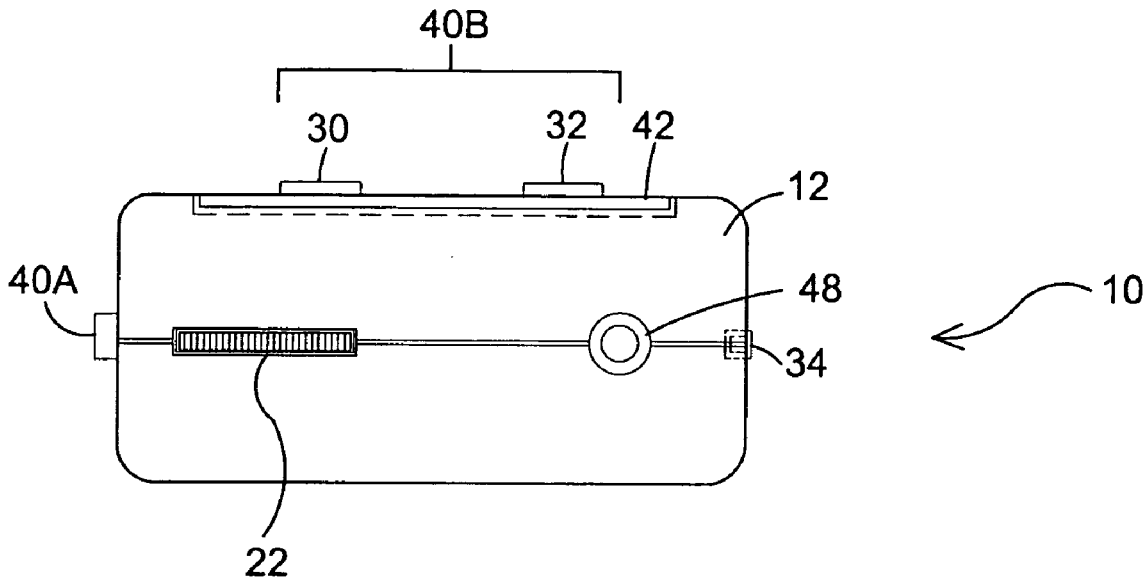
FIG. 5 is a top view of the recording device of the present invention.

FIG. 5 is a top view of the recording device 10 of the present invention. A plurality of pieces fit together as the main body 12. Positioned on the outside of the recording device 10 is the volume control 22, AC/DC power socket 34, first set of control buttons 40, second set of control buttons 41, LCD screen 42, and audio output jack 48. First set of control buttons 41 includes the PLAY control button 30 and RECORD control button 32.

Upon pressing the RECORD control button 32, processor 14 signals the memory 16 to store data received from the microphone 18. Additionally, the processor 14 signals the LCD display to display "REC" thereon indicating the device is in the record mode. Preferably, the microphone 18 captures analog audio data representing the user's voice. The audio data is then converted into digital data and stored in the memory 16. If data was previously stored in memory 16, the previously stored data will be automatically deleted and replaced by the new message.

Upon pressing the PLAY control button 30, processor 14 signals the memory 16 to convert the digital data into analog data for output by the speaker 20. Hereinafter, the above described process will be known as "Replay." Simultaneously, the processor 14 signals the LCD display 42 to display "PLAY" thereon indicating the device is in the play mode. The Replay can be terminated at any time by pressing either the PLAY control button 30 or RECORD control button 32. If the user wishes to listen to the Replay through earphones, the earphones can be inserted into audio output jack 48, which causes the Replay to be output through the audio output jack 48. The user can also adjust the volume of the Replay by selectively moving the volume control 22 for increasing and decreasing the level at which Replay is output through the speaker 20 or audio output jack 48.

Figure 6:
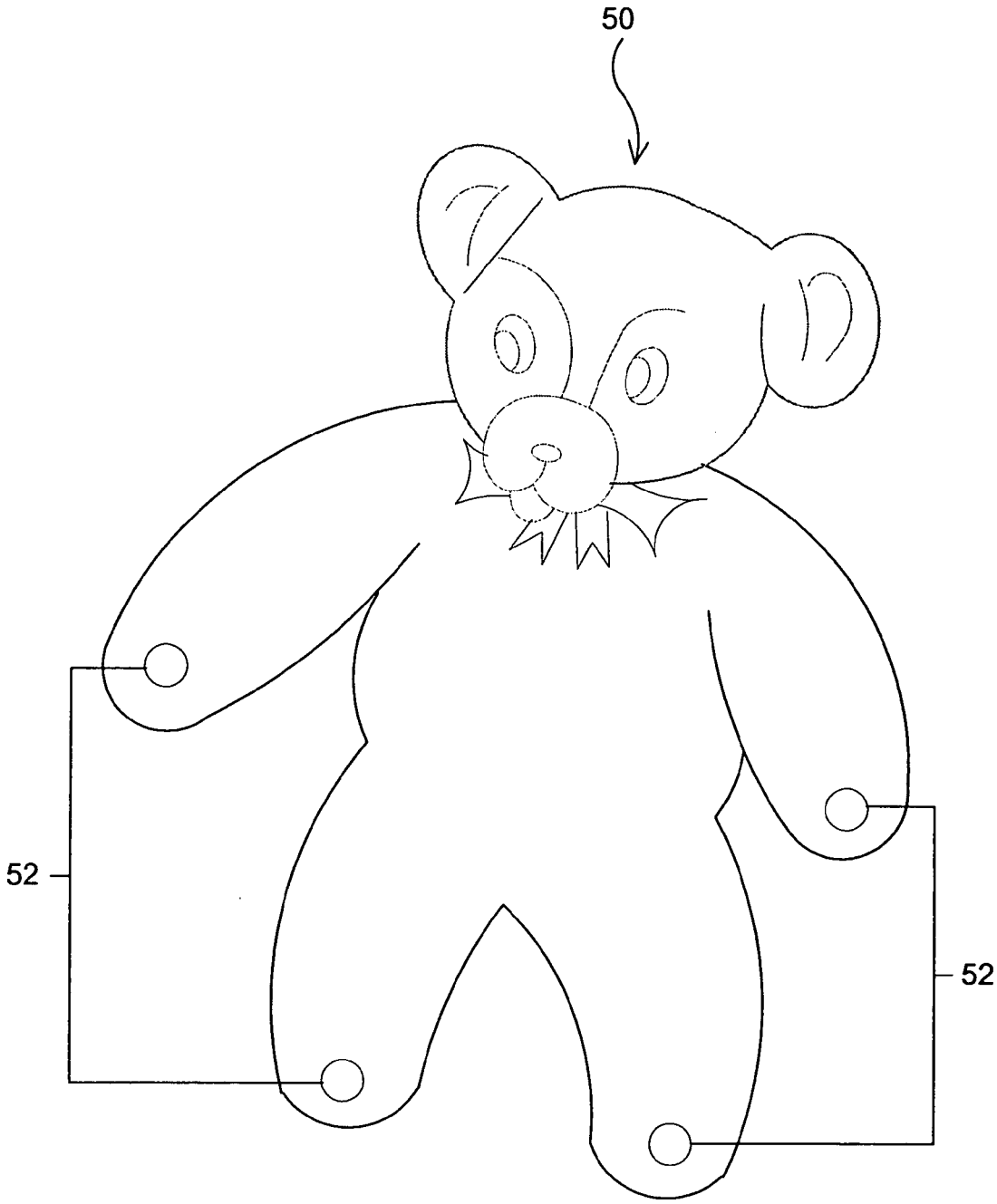
FIG. 6 is a front view of a teddy bear encasing of the recording device of the present invention.

FIG. 6 is a front view of the teddy bear encasing 50. The recording device 10 as shown in FIG. 1 is positioned within the teddy bear encasing. The user can activate the control buttons as shown in FIG. 1 by pressing control button extensions 52, which are preferably strategically located on paws of the teddy bear. The above is described for purpose of example only and the encasing is not limited to teddy bears, but may also include any stuffed animal encasing that is conducive to the operation of the recording device by children. The operation of the recording device 10 is shown in more detail in FIGS. 1–5 and 8.

Figure 7:
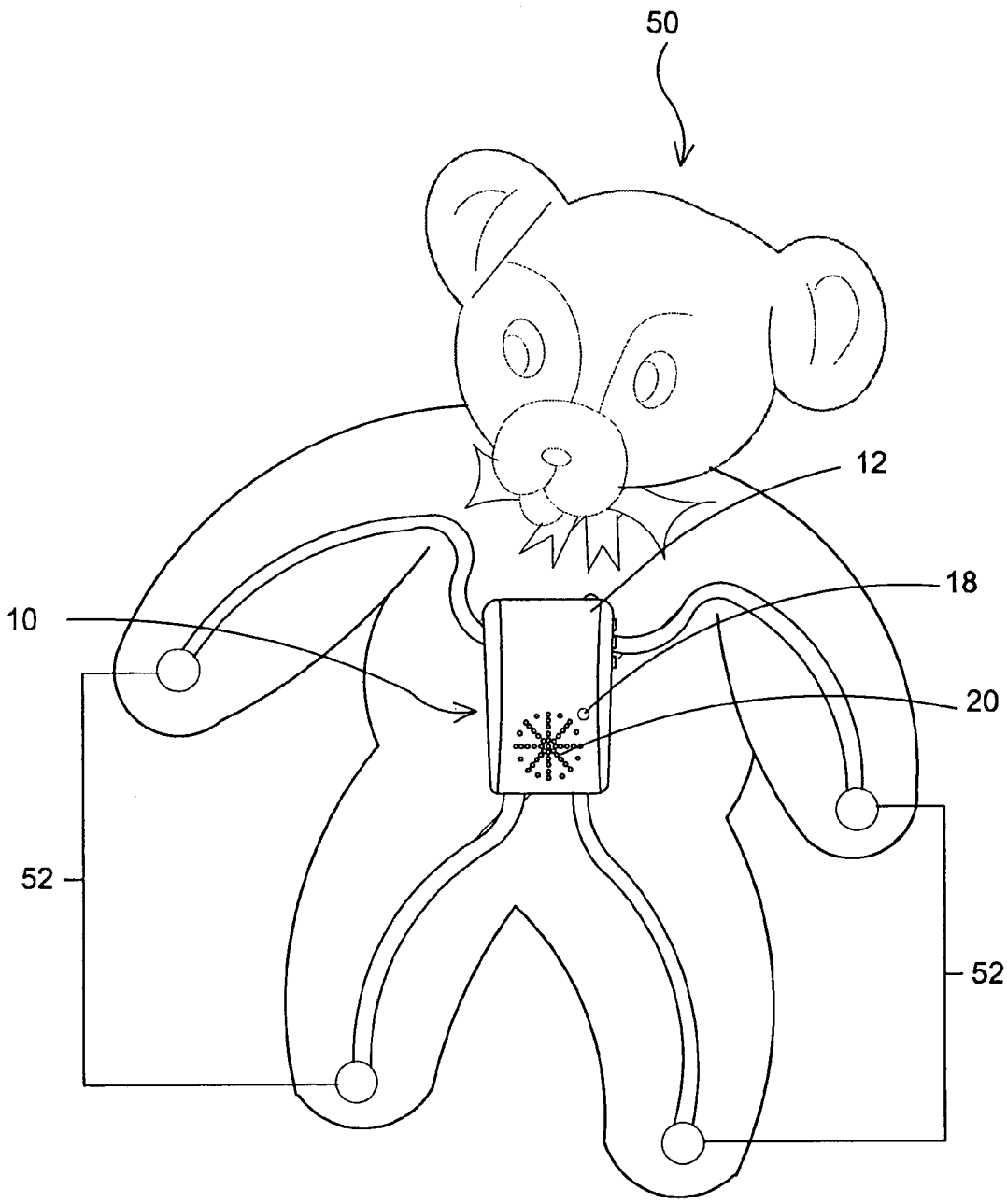
FIG. 7 is a cut-away view of the teddy bear encasing of the recording device of the present invention.

FIG. 7 is a cutaway view of the teddy bear encasing 50. The main body 12 of the recording device 10 is positioned within the teddy bear encasing 50. If the user presses the control button extension 52 that corresponds to the RECORD control button 32 (e.g., the left paw), the recording device 10 can selectively record the voice message of the user through the microphone 18. If the user presses the control button extension 52 that corresponds to the PLAY control button 30 (e.g., the right paw), the recording device 10 can produce a Replay of the user's voice message through the speaker 20. If the user presses the control button extension 52 that corresponds to the START control button (e.g., the left foot), the recording device produces a Replay, or set of Replays, in accordance with an internal timing mechanism of the recording device 10. The operation of the recording device 10 is described herein above and after with specific reference to FIGS. 1–5 and 8.

Figure 8:
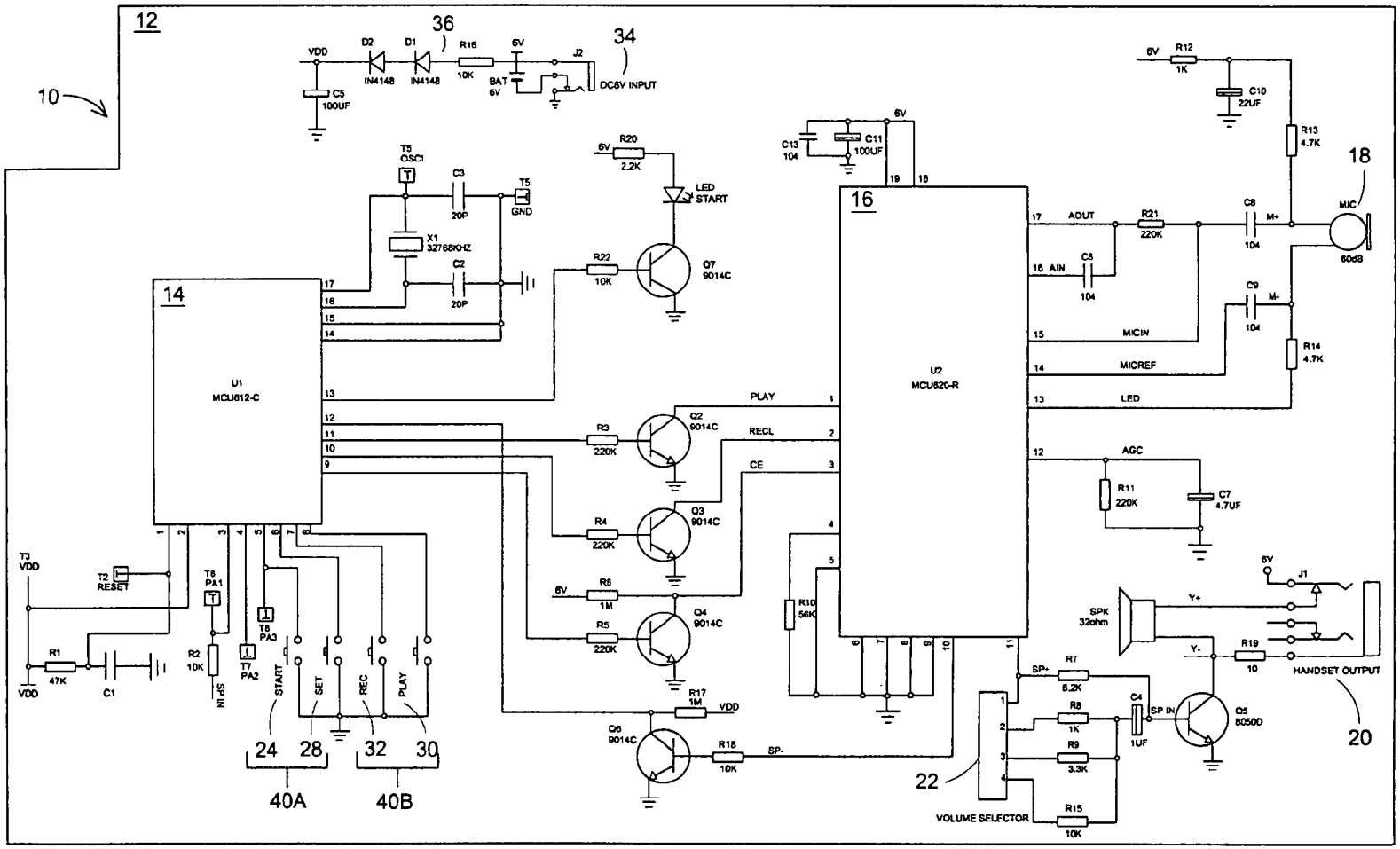
FIG. 8 is a schematic diagram of the recording device of the present invention.

FIG. 8 is a schematic diagram of the recording device 10 of the present invention. A plurality of pieces fit together as the main body 12. The internal parts include the processor 14 and the memory 16, which communicate with each other and other parts through a set of connections. The main body 12 also includes power source 36, which includes a battery and power acquired from external sources via AC/DC power socket 34. The power source 36 provides power to any part of the recording device 10 that requires power. The external parts of the recording device 10 include the microphone 18, speaker 20, volume control 22, control button set 40, control button set 41, LCD screen 42, audio output jack 48, and AC/DC power socket 34. Control button set 40 includes START control button 24, MODE control button 26 (as shown in FIG. 1), and SET control button 28. Control button set 41 includes PLAY control button 30 and RECORD control button 32. All control buttons 24, 26, 28, 30, and 32 are connected to the processor 14. The microphone 18 and speaker 20 are connected internally to the memory 16. The volume control 22 is connected indirectly to both the memory 16 and the speaker 20. Alternatively, if the recording device 10 is positioned within the teddy bear encasing 50 as shown in FIGS. 6 and 7, a plurality of control button extensions 52 correspond to the first set of control buttons 40 and second set of control buttons, which are further connected to processor 14.

Upon pressing the RECORD control button 32, processor 14 signals the memory 16 to store data received from the microphone 18. Additionally, the processor 14 signals the LCD display to display "REC" thereon indicating the device is in the record mode. Preferably, the microphone 18 captures analog audio data representing the user's voice. The audio data is then converted into digital data and stored in the memory 16. If data was previously stored in memory 16, the previously stored data will be automatically deleted and replaced by the new message.

Upon pressing the PLAY control button 30, processor 14 signals the memory 16 to convert the digital data into analog data for output by the speaker 20. Hereinafter, the above described process will be known as "Replay." Simultaneously, the processor 14 signals the LCD display 42 to display "PLAY" thereon indicating the device is in the play mode. The Replay can be terminated at any time by pressing either the PLAY control button 30 or RECORD control button 32. If the user wishes to listen to the Replay through earphones, the earphones can be inserted into audio output jack 48, which causes the Replay to be output through the audio output jack 48. The user can also adjust the volume of the Replay by selectively moving the volume control 22 for increasing and decreasing the level at which Replay is output through the speaker 20 or audio output jack 48.

If the user presses the START control button 24, the processor 14 signals the memory 16 to perform a Replay in accordance with a timing mechanism configured in processor 14. The timing mechanism predetermines the intervals at which Replays occur. For example, the timing mechanism may include a cycle of twenty Replays simultaneously, followed by a delayed period of an hour, followed by another cycle of twenty Replays, for seven hours. In the above example, the processor 14 signals the memory 16 to perform a Replay 20 consecutive times. The processor 14 includes a timing mechanism for keeping time. When one hour has expired according to the timing mechanism in the processor 14, the processor signals the memory 16 to Replay the stored data twenty consecutive times. The processor 14 would continue this cycle until the timing mechanism determines that a seventh hour has passed. The pattern continues until the cycle of the timing mechanism completes or the user terminates the cycle by pressing the PLAY control button 30. Preferably the default configuration of the timing mechanism is as follows: one Replay and then stop; one hour later Replay twenty times and then stop; two hours later Replay twenty times and then stop; two hours later Replay twenty times and then stop; two hours later Replay twenty times and then stop. However, the above is described for purpose of example only and the cycle of Replays may be performed at any time intervals and for any number of cycles.

If the user presses and holds the SET control button 28 for a predetermined amount of time, the processor 14 causes control buttons 24, 26, 30, and 32 to be locked in an inoperable state. The processor 14 simultaneously signals the LCD display 42 to display "HOLD" thereon. When the user presses and holds the SET control button 28 for a second predetermined amount of time, the processor 14 causes the control buttons 24, 26, 30, and 32 to be unlocked and operable. Preferably, the predetermined amount of time is two seconds. However, the predetermined amount of time may be greater or less than two seconds.

From the above description it can be seen that the present invention overcomes the shortcomings of the prior art by providing a recording device that repeats a message several times in one set and in delayed intervals between sets. The recording device provides an ideal medium for affirmation, self-hypnotic suggestion, or subliminal instruction. The recording device looks like an alarm clock and can be unnoticeably placed next to a user's bed. The alternate embodiment of the invention including the teddy bear encasing can be unnoticeably placed near a child's bed. The timing mechanism allows the user to listen to the affirmations, self-hypnotic suggestions, or subliminal instructions while in the subconscious state of sleep.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for recording and replaying an audio subliminal message comprising:

a) a housing containing a recording device, said housing mounted within a stuffed animal, said recording device having a plurality of control buttons for controlling the recording device comprising record and play buttons, a start button, a mode button, and a set button;

b) a processor in said recording device connected to the plurality of control buttons for communicating instructions to various parts of the recording device;

c) a memory connected to the processor for storing said subliminal message;

d) said recording device including a microphone connected to the memory for receiving said subliminal message and providing the subliminal message to the memory for storage;

e) a speaker connected to the memory for outputting the subliminal message wherein upon activation of the record button said microphone is controlled to receive said subliminal message and provide the received subliminal message to said memory for storing the subliminal message and upon activation of the play button said processor controls said memory to provide stored subliminal message for audiblizing by said speaker;

f) said start button upon activation causing the processor to signal the memory to replay said stored subliminal message repetitiously at each of preselected intervals of time stored in said memory;

g) said mode button upon being pressed for a predetermined amount of time causes said processor to instruct the recording device to enter into a clock setting mode, said set button upon being pressed causing time values to change; and h) a plurality of control button extensions corresponding to each of said plurality of control buttons, said plurality of extensions being positioned on an outer surface of said stuffed animal.

2. The apparatus as recited in claim 1, farther comprising an LCD display connected to said processor for indicating an operating mode of said apparatus.

3. A method for recording and replaying an audio subliminal message comprising the steps of:

a) mounting a recording device within a stuffed animal, said recording device having a plurality of control buttons for controlling the recording device comprising record and play buttons, a start button, a mode button and a set button, said recording device receiving said subliminal message through a microphone upon activation of said record button, said plurality of control buttons having control button extensions corresponding to each of said plurality of control buttons, said button extensions being positioned on an outer surface of said stuffed animal;

b) storing the received subliminal message in a memory; and c) providing the stored subliminal message to a speaker for audiblizing the stored subliminal message upon activation of said play button; and d) activating said start button causing the processor to signal the memory to replay said stored subliminal message repetitiously at each of predetermined intervals of time stored in said memory.

4. The method as recited in claim 3, further comprising the step of converting the subliminal message from analog to digital form prior to said step of storing.

5. The method as recited in claim 4, wherein the predetermined intervals comprise audiblizing the subliminal message a first time, followed by twenty repetitions of the subliminal message one hour later, followed by twenty repetitions of the subliminal message two hours later.

6. The method as recited in claim 5, further comprising the step of repeating audiblizing of the subliminal message at twenty repetitions in two hour intervals.

7. The method as recited in claim 6, wherein repeating audiblizing of the subliminal message at twenty repetitions in two hour intervals ceases after the third interval.

* * * * *